US006438495B1

(12) United States Patent
Chau et al.

(10) Patent No.: US 6,438,495 B1
(45) Date of Patent: Aug. 20, 2002

(54) METHOD FOR PREDICTING THE DIRECTIONAL TENDENCY OF A DRILLING ASSEMBLY IN REAL-TIME

(75) Inventors: Minh T. Chau, Sugar Land; William G. Lesso, Jr., Katy; Iain M. Rezmer-Cooper, Sugar Land, all of TX (US); Dominic P. McCann, West Vancouver (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/579,609

(22) Filed: May 26, 2000

(51) Int. Cl.[7] ..... G01V 3/18
(52) U.S. Cl. ..... 702/9
(58) Field of Search ..... 702/9; 73/152.01, 73/152.02, 152.03; 175/24–27, 39, 40, 45, 50; 340/853.5, 853.4, 853.6

(56) References Cited

U.S. PATENT DOCUMENTS

| | | | | |
|---|---|---|---|---|
| 4,733,733 A | * | 3/1988 | Bradley et al. | 340/853.4 |
| 4,804,051 A | * | 2/1989 | Ho | 175/26 |
| 5,341,886 A | * | 8/1994 | Patton | 175/24 |
| 5,439,064 A | | 8/1995 | Patton | |
| 5,456,141 A | * | 10/1995 | Ho | 76/108.2 |
| 5,608,162 A | | 3/1997 | Ho | |

FOREIGN PATENT DOCUMENTS

| | | |
|---|---|---|
| GB | 2186715 | 8/1987 |
| GB | 2210481 | 6/1989 |

OTHER PUBLICATIONS

Lesso et al., "Quantifying Bottomhole Assembly Tendency Using Field Directional Drilling Data and a Finite Element Model" (Mar. 1999), SPE/IADC 52835, pp 113–128.

Birades et al., "ORPHEE 3D: Original results on the Directional Behavior of BHAs with Bent Subs" (Oct. 1989), SPE 19244, pp 1–16.

Schlumberger GeoQuest Bulletin, 3rd/4th Quarter 1999, Mark Burgoyne, "PowerPlan" pp. 24 and 25.

Combined Search and Examination Report from GB Patent Office dated Jan. 31, 2002.

* cited by examiner

*Primary Examiner*—Donald McElheny, Jr.

(57) ABSTRACT

The invention uses the continuous inclination, direction and tool-face information supplied from either an MWD tool and/or a rotary steerable drilling system, and/or other downhole equipment, e.g., the at-bit inclination measurement (AIM), to give a prediction of the tendency of a rotary, steerable, or rotary steerable system. These measurements are used with a finite element mathematical model of the drilling process to continually calibrate in real-time the drilling parameters that are not obtainable from measurements, and to refine the subsequent tendency prediction in real-time. The continuous data will be used in conjunction with the accepted survey measurements (which occur less frequently than the continuous inclination and direction measurements) so that the optimum slide and rotation ratio between well sections can be selected, and drilling targets can be more accurately hit.

46 Claims, 8 Drawing Sheets

METHOD FOR PREDICTING THE DIRECTIONAL TENDENCY OF A DRILLING ASSEMBLY IN REAL-TIME

FIELD OF THE INVENTION

This invention relates to a method for predicting the direction and inclination of a drilling assembly during the process of drilling a wellbore in an earth formation and in particular to a method for predicting the direction and inclination tendencies of a drilling assembly in real-time using continuous data.

BACKGROUND OF THE INVENTION

Directional drilling is the process of directing the wellbore being drilled along a defined trajectory to a predetermined target. Deviation control during drilling is the process of keeping the wellbore contained within some prescribed limits based on the inclination angle or the deviation from the vertical of the drill bit, or both. Strong economic and environmental pressures have increased the desire for and use of directional drilling. In addition, wellbore trajectories are becoming more complex and therefore, directional drilling is being applied in situations where it has not been common in the past.

The trajectory of a wellbore is determined by the measurement of the inclination and direction (azimuth) of the drill string at various formation depths, and by a 'survey calculation', which represents the path between discrete points as a continuous curve. In the initial drilling of a well or in making a controlled trajectory change in wellbore trajectory, some method must be used to force the drill bit in the desired direction. Whipstocks, mud motors with bent-housings and jetting bits are used to initially force the bit in a preferred direction. New Rotary steerable systems also enable directional control while rotary drilling. All of the above bit deflection methods depend on manipulating the drill pipe (rotation and downward motion) to cause a departure of the bit in either the direction plane or the inclination plane, or both. Many terms are used in describing the directional drilling process. For the purpose of describing the directional drilling process, the following critical terms are defined:

Tool face: this can be 'magnetic tool-face' when referred to magnetic North, or 'gravity tool-face' when referred to the high side of the hole, and is the angle between the high-side of the bend and North of the high side of the hole respectively. A tool-face measurement is required to orient a whipstock, the large nozzle on a jetting bit, an eccentric stabilizer, a bent sub, or a bent housing.

Tool azimuth angle: the angle between North and the projection of the tool reference axis onto a horizontal plane, also called 'magnetic tool face'.

Tool high-side angle: the angle between the tool reference axis and a line perpendicular to the hole axis and lying in the vertical plane.

This angle is also called the 'gravity tool face'.

Inclination and azimuth (direction) can be measured with a magnetic single or multi-shot and a gyroscope single or multi-shot. Magnetic tools are run on a wireline, or in the drill collars while the hole is tripped or they can be dropped from the surface. Some gyroscopic tools are run on conductor cable, permitting the reading of measurements from the surface and also permitting the supplying of power down the conductor cable. Another way to measure direction, inclination and tool face is with an arrangement of magnetometers and accelerometers. Batteries, a conductor cable, or a generator powered from the circulation of the drilling mud can supply power to the tools taking these measurements. If the measurement tool is located in the bottom hole assembly (BHA) and the measurements are taken during drilling, the tool is called a measurement while drilling (MWD) tool. Details of various measurement tools, the principle of operation, the factors that affect the measurement and the necessary corrections are known to persons of ordinary skill in this technology.

The two most common MWD systems are the pressure-pulse and modulated pressure pulse transmission systems. The pressure pulse system can be further divided into positive and negative pulse systems. At the surface, the downhole signals are received by a pressure transducer and transmitted to a computer that processes and converts the data to inclination, direction and tool-face angle measurements.

Most sensor packages used in an MWD tool consist of three inclinometers (accelerometers) and three magnetometers. The tool-face angle is derived from the relationship of the hole direction to the low side of the hole, which is measured by the inclinometers. Once the readings are measured, they are encoded through a downhole electronics package into a series of binary signals that are transmitted by a series of pressure pulses or a modulated signal that is phase-shifted to indicate a logical unity or zero.

Inclination measurements at the bit can be measured during the drilling process with an 'at-bit' inclination (AIM) tool that is a single axis accelerometer mounted in the driveshaft of a motor. With this tool, the inclination measurement is continuously updated in both steering and rotary mode. The sensor measures the inclination of the hole at the location where the bit is currently drilling, as opposed to the inclination measurements at a section of the bottom hole assembly some distance away from the bit location, as is the case with standard MWD systems. Using the at-bit survey tool, a directional driller (DD) can initiate a steering section and see the result of steering within 5 feet, as opposed to the 50 feet or so required with a conventional MWD/LWD system. The resulting well path will be smoother and require less steering to maintain the proper trajectory. This means more rotary drilling, which in turn, means greater drilling efficiency.

Prediction of Drilling Tendency

Predicting the directional tendency of a bottom hole drilling assembly is a key element in improving the efficiency of the directional drilling process. Directional wellbores are drilled by incorporating elements into the BHA that will cause the hole to deflect in a desired manner. Stabilizers between drill collars cause a bowing action that can build, hold or drop inclination according to the placement of the stabilizers. The tendency of a BHA whilst rotary directional drilling is difficult to predict and requires years of experience for a directional driller to achieve the desired results. Steerable systems, introduced about fifteen years ago, have a bend (bent sub) in them. A positive displacement motor (PDM) turns the bit below the bend. The bend is held stationary at the desired attitude or tool face angle, resulting in wellbore curvature as drilling proceeds. Steerable system directional drilling has proven to be more practical than the rotary method. However, problems in predicting the directional tendency of both types of directional BHA's still leads to inefficiencies in the drilling process. Time is lost in tripping rotary BHA's out of the hole to alter their directional characteristics, and in slower drilling with steerable systems, where the end settings are less than optimal.

One method of predicting wellbore directional tendencies is through modeling. Finite element models attempt to represent the detailed physical interactions between the BHA and the wellbore while drilling. However, effective use of such models has been hindered by parameters that are difficult to quantify, particularly the hole gauge, the strength of the formation, and the bit anisotropy.

Prior directional tendency predictions were based on classical engineering mechanics relationships. These models often worked well, but in a limited geographic area, perhaps even one oil field, and required significant expertise. The use of steerable systems introduced stress concentrations that were more difficult to model. Further improvement in tendency predictions needed three dimensional stress models and a wider set of data for validation. The increased use of finite element programs and directional drilling databases has made more accurate tendency predictions possible, but still limited to particular geographical regions. Attempts to predict BHA tendency has slowed in recent years due to the inability to use these models efficiently or without the necessary expertise.

A typical BHA tendency mathematical model calculates the borehole curvature that induces zero side-force, or an equilibrium curvature. If a constant curvature hole is drilled, then the resultant force at the bit of the deflected BHA must be tangential to the borehole axis, i.e., the side-force (normal to the borehole axis) at the bit has to be zero. However, to calculate the true instantaneous tendency, the BHA must be placed in a mathematical description of anactual borehole geometry, so that the side-forces at the bit can be accurately modeled. This side-force at the bit can be based on a three-dimensional finite element model. The BHA is modeled by a string of beam elements with each element having six degrees of freedom (three displacements and three rotational). Contact between the borehole and the BHA is modeled by generating at each node a non-linear spring which generates a reactive force proportional to the excess amount of transverse displacement over the annular spacing. The stiffness of the spring is represented by a formation stiffness parameter, and can be related to the mechanical properties of the formation.

Modeling of a bent sub consists of introducing a discontinuity of the tangent vectors at the common node between two consecutive beam elements. The magnitude and direction of the discontinuity are determined by the bend angle and its direction, or tool face. A matrix of stiffness values and the applied forces at each node is then generated. The stiffness matrix is composed of the linear stiffness of the BHA and the non-linear terms due to the non-linear spring representing the contact between the BHA and the borehole. The applied forces are then updated including the reactive forces of the non-linear spring. Displacement and nodal reactive forces are solved iteratively using a fast numerical solver. The side-force at the bit is then determined by computing the component of the reactive force at the bit normal to the borehole axis. The side force at the bit has two components: the inclination side force is the component in the vertical plane that contains the bit axis, and the azimuth side force is the component in the horizontal plane, and perpendicular to the borehole axis. The inclination side force at the bit will control the build/drop tendency of the BHA, and the azimuthal side force will control the walk tendency of the BHA.

Bottom Hole Assembly (BHA) in Directional Drilling

Selecting the BHA design together with maintaining its orientation are the most critical parts of the Directional Drillers (DD) job. Minimizing trips for BHA changes is a key objective for the client. Traditionally, when a "new" DD arrives in an area, the only aid the driller has in selecting a suitable BHA for the planned trajectory is its performance in previous wells. The selection of the BHA configuration affects the direction and 'smoothness' of the wellbore trajectory. The design of the BHA can vary from very simple (bit, drill pipe, collars) to a complex BHA, containing multiple stabilizers, and various MWD and logging-while-drilling (LWD) tools. All BHA's cause a side force at the bit that leads to: (a) an increase in hole inclination (positive side force—fulcrum effect), (b) no change in inclination (zero net side force—a lockup BHA), and (c) a drop inclination (negative side force—pendulum BHA).

BHA assemblies encounter some common problems during directional drilling operations that include:

- Formation effects—BHA behavior can change suddenly after very predictable tendencies. This can be due to a formation change or a change in the dip or strike of the formation, or the presence of a fault
- Worn Bits—A BHA, which had been holding inclination, may start to drop as the bit becomes worn. If the survey point is significantly behind the bit, this decrease in angle might not be seen in time. If the wear is misinterpreted as a balled-up bit, and drilling continues, serious damage may be done to the formation.
- Accidental sidetrack—in soft formations where a multi-stabilizer BHA is run immediately after a mud motor/bent sub kick-off run, great care must be taken to avoid sidetracking.
- Differential sticking—where this is a problem, more than three stabilizers may be run in an effort to minimize wall contact. It is vital to minimize the time taken for surveys (even with MWD) in a potential differential sticking area. A stuck drillstring/BHA can be expensive to recover, or may not be recovered at all.
- Effects of Drilling Parameters—High RPM acts to stiffen the drill string. Polycrystalline diamond compact (PDC) bits normally have a tendency to walk to the left, and experience in the location has to be used to allow for this. Drilling parameters normally are changed after every survey.

One important BHA operational parameter is the 'gravity tool face'. Gravity tool face orientation is represented in FIG. 1. In this figure, the tool face positions are indicated by 10. On the backside of the tool is a deflecting (or bent-) sub 11. By rotating the drill string and the deflecting sub 11, there are several courses 12*a*–12*h* that the wellbore could take. Directional drillers use some basic rules to aid with directional drilling control: Above 30° inclination and when using a bent sub and a PDM, and with tool face settings of 60° way from the high side, the hole will normally drop the inclination as well as turn. This effect is more evident at higher inclinations, and when turning left the effect is most pronounced, as the reactive torque acts in the same direction as the weight of the BHA, and tends to 'flop over' the motor. Thus, when performing a left-hand correction, great care must be taken in setting tool face. If the tool 'flops over', a severe dogleg can result due to the hole dropping inclination while turning left. Higher inclination can cause greater damage to the hole. Unconsolidated formations can also enhanced this effect.

Another important operational parameter in a steerable BHA is 'Slide Follow-through'. A BHA run is a series of segments that may alternate between steerable (slide drilling) 13 and rotary drilling 14 as shown in FIG. 2. In this figure, there are six slide-drilling segments 13 totaling 94 feet and seven rotating segments 14 totaling 143 feet. The bend is positioned at various tool face angles during the sliding segments. There may be a lag in the tendency from one mode to another. This lag is termed 'BHA follow through', and is due to the inherent inertia of the drilling assembly, and is usually expressed as an additional percentage of the sliding segment footage. A positive sliding percentage means that the sliding tendency carries on into the rotary section, while a negative value means that part of the sliding acts like a rotary section.

There are three characteristics of the BHA description that can substantially affect the tendency in a given formation:

The placement and gauge of the stabilizers

The angle of the bend or bends associated with a steerable system

The distance of the bend(s) above the bit

There are some informal rules that the directional driller uses to aid with directional control. In general, these rules are based on the ratio between the BHA bending stiffness and the formation stiffness:

Adding stabilizers increases the BHA bending stiffness

Increasing the downhole weight-on-bit

Lateral Vibrations close to resonant frequencies reduce the BHA bending stiffness Hole wash-outs reduce the BHA bending stiffness as the stabilizers lose their intended functionality The side-force at the bit is controlled by the BHA/wellbore interaction The Drilling direction is controlled by the bit/stabilizer(s) and formation interaction.

If the directional driller needs to make a correction because a target is going to be missed, a target extension or a correction run is needed. The closer the directional driller gets to the target the more direction change that will be needed to hit it. However, if a correction is made too soon, the tool may continue to 'walk' or may turn in the opposite direction. Therefore, an examination of the true historical tendency in the previously drilled section is advantageous before making a decision to change course.

The surveying of directionally drilled wells has improved from crude single station devices to highly accurate gyros and measurements made during drilling close to the bit. The increased use of steerable system motors in bottom hole assemblies (BHAs) has made a wide range of trajectories possible, including horizontal wells. The directional requirements of these wells have fueled the development of these better survey sensors. A survey was typically taken at each pipe joint connection (30 ft) or each stand of pipe (90 ft) with top-drive systems. High-speed data transmission MWD systems now make it possible to take surveys during drilling in a near continuous fashion. The use and analysis of this continuous survey data details the process if rotary, steerable motor and rotary steerable directional drilling. The result is more accurately and efficiently drilled directional wells.

MWD tools can typically measure the wellbore inclination and azimuth every 90 seconds. This means that a survey can be taken every 2 to 3 feet (or less) while drilling instead of 30 to 90 feet. Most directional drilling is a series of rotary drilling followed by a section of oriented or slide-drilling with a steerable motor. Each section is typically 10 to 20 ft in length. It has long been suspected that the hole curvature or doglegs of the oriented section were substantially higher than those in the rotary-drilled sections. The longer distances between standard surveys masked this result. FIG. 3 shows direction (azimuth) 15 and inclination 16 for continuous and survey static measurements. As shown, the continuous measurements highlight the rich detail of the well trajectory that is missed by only representing the well path by the survey stations 17. The continuous direction and inclination (D&I) measurements shown as small circles 18 reveal a significantly more accurate representation of the true well path.

The directional tendency of the drilling assembly between surveys 19 is currently estimated by two methods. The first method is the directional driller (DD) using his knowledge of a location and a particular assembly. This knowledge is usually not transferable to a different location. The second method uses a static finite element mathematical model. Static predictions of BHA tendency from finite element tendency analysis have been considered unreliable because several of the parameters needed for the analysis are not readily measurable. With the inclusion of these unmeasureable parameters, the reliability of the BHA predictions would increase considerably.

Simple real-time models that predict the total build-up rate (BUR) of the borehole using only the measured survey data are known. A real-time model computes the slide and rotate BUR's and the depth-based gravity tool face from two surveys at a time. This model cannot allow for the continuous changes that can occur in the trajectory between the survey points 17 by continuous points 18 (as evidenced in FIG. 3), nor can it allow for the bit anisotropy, hole enlargement, formation effects, follow-through and other variations in the drilling parameters, which give rise to the significant deviations in trajectory from that obtained by a minimum curvature calculation between the two survey points. However, the lack of resolution in the survey data can lead to tortuous or undular well paths being drilled. This can lead to the drill string being subjected to potentially destructive forces while drilling, problems running casing, targets being missed, and lower production rates.

SUMMARY OF THE INVENTION

An object of this invention is to develop a method to more readily predict the trajectory of a wellbore being drilled using the information from the model of the drilling parameters.

Another object of the present invention is to create a means to numerically model drilling parameters that are not readily measurable in the conventional drilling process.

A third object of this invention is to develop a means to alter the projected trajectory of a wellbore during the drilling process such that the wellbore will reach a targeted formation location.

The present invention uses the availability of real-time and continuous direction and inclination (D&I) measurements of the drilling assembly from the MWD or rotary steerable systems. These D&I measurements, coupled with drilling mechanics measurements, and the overall history of the well trajectory enable the parameters in the numerical models to be calibrated in real-time, and thus give more accurate predictions of both the bit location and the tendency of the wellbore beyond the current bit location. The continuous data will be used in conjunction with the accepted survey measurements (which occur less frequently than the continuous inclination and direction measurements) so that the optimum slide and rotation ratio between well sections can be selected, and drilling targets can be more accurately reached.

In operation, this invention predicts the directional tendencies of a drilling assembly in real-time by first acquiring static and real-time continuous data of a drilling environment. This data includes relevant surface and down hole parameters. The next step is to calibrate the trajectory tendency control parameters that include the formation stiffness (FS), the hole enlargement (HE) and the bit anisotropy index (BAI). The third step involves predicting the wellbore trajectory using the calibrated trajectory control parameters.

DETAILED DESCRIPTION OF THE INVENTION

The present invention describes a technique that uses the continuous inclination, direction and tool face information supplied from either an MWD tool and/or a rotary steerable drilling system, and/or other downhole equipment, e.g., the at-bit inclination measurement (AIM), to give a prediction of the tendency of a wellbore being drilled by a rotary, steerable, or rotary steerable system. These continuous inclination and direction and tool face information measurements are used with a finite element mathematical model of the drilling process to continually calibrate the drilling parameters (HE, FS and BAI) not obtainable from measurements, and to refine the tendency prediction of the wellbore in real-time. The continuous data is used in conjunction with the accepted survey measurements (which occur less frequently than the continuous inclination and direction measurements) so that the optimum slide and rotation ratio between continuous well sections can be selected, and drilling targets can be more accurately reached.

Figure 1:
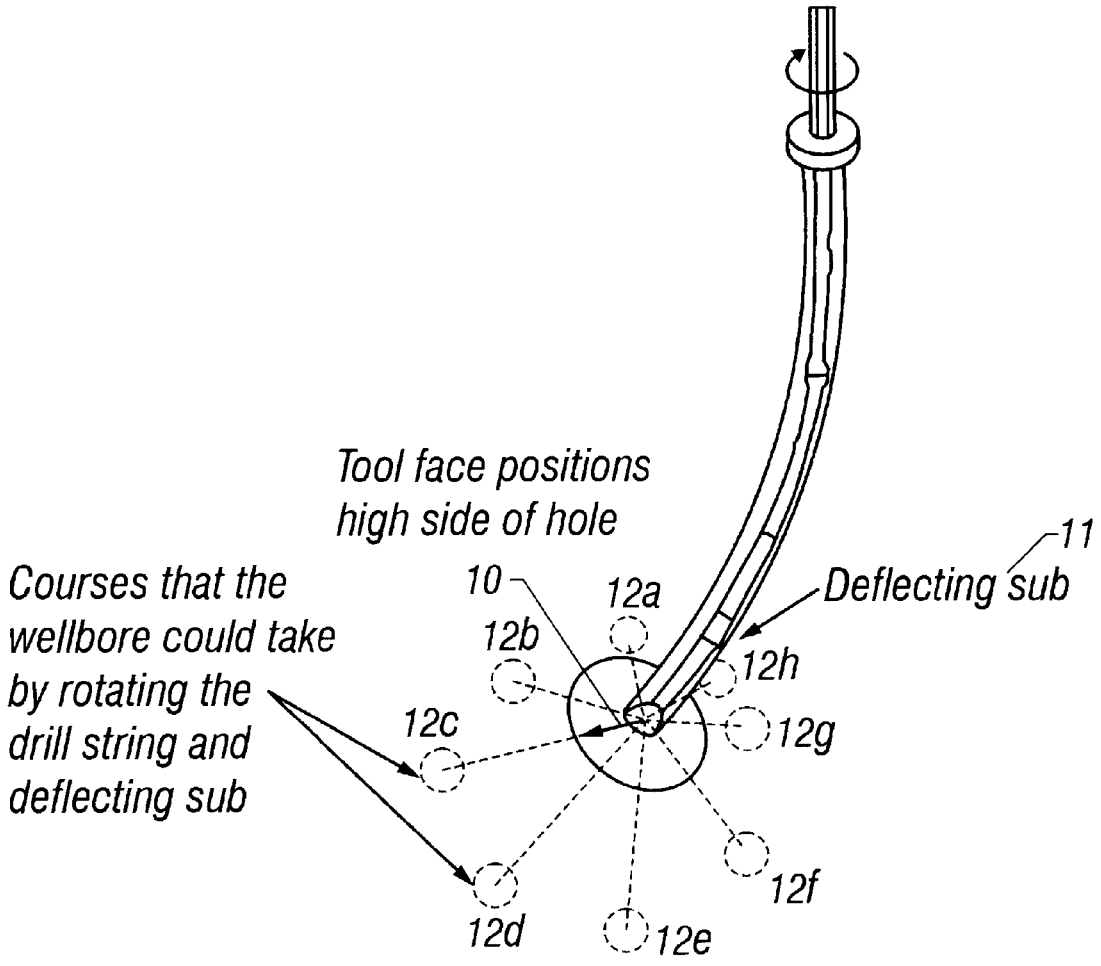
FIG. 1 is a view of the tool face position and system for deflecting the wellbore trajectory.
Figure 2:
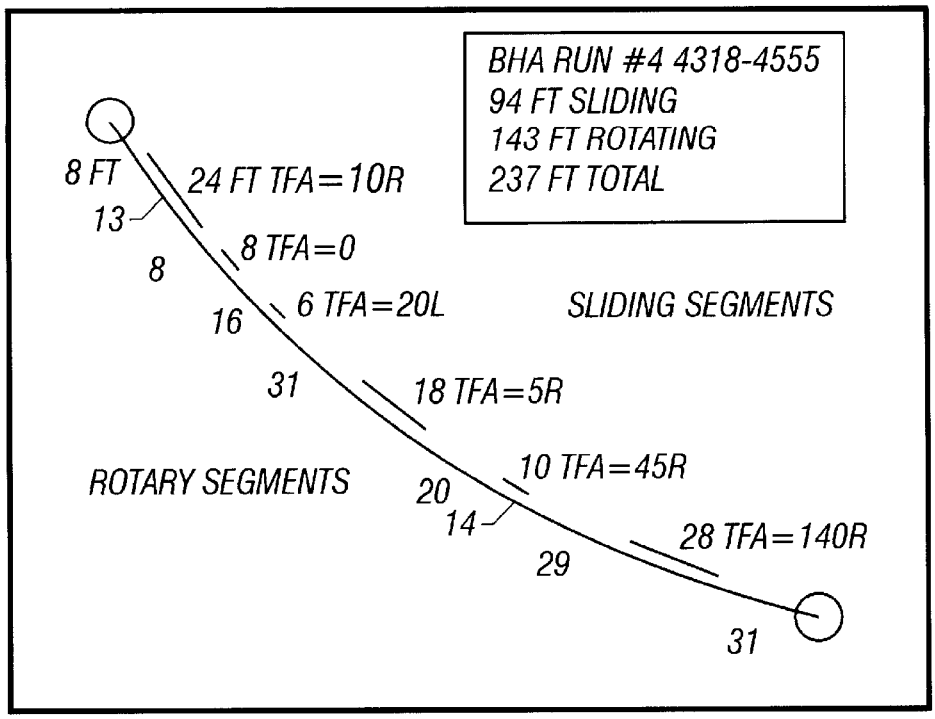
FIG. 2 is a view of alternating slide and rotary segments in a typical BHA run.
Figure 3:
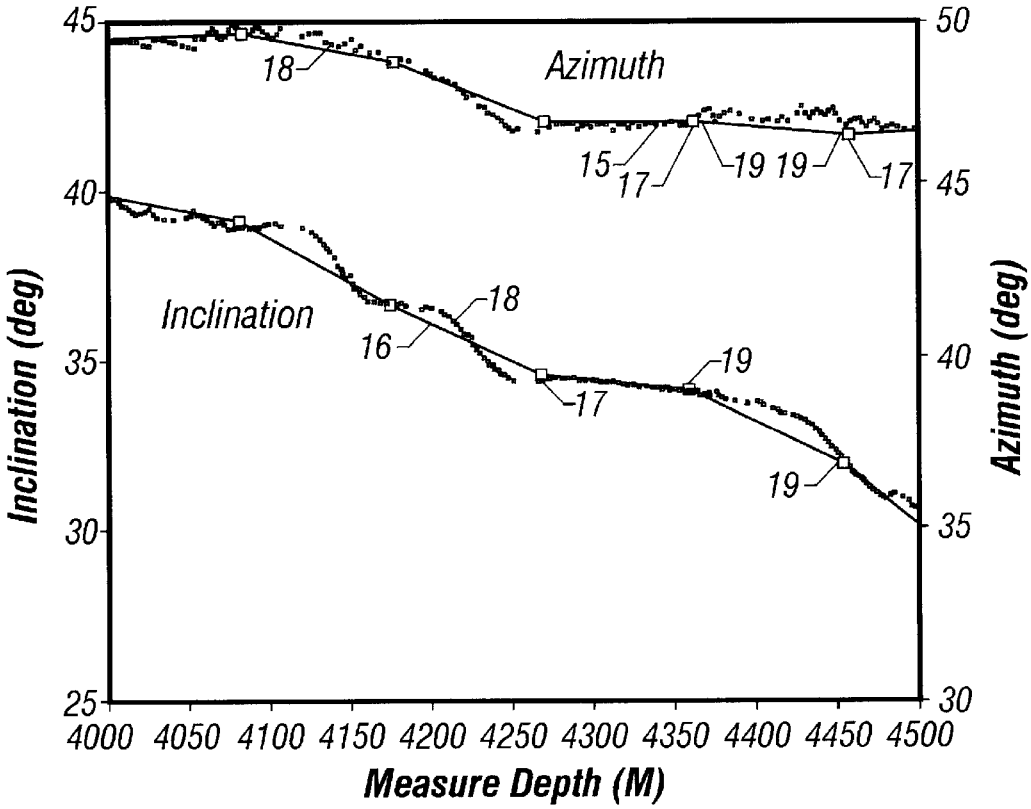
FIG. 3 is a comparison between survey data and continuous direction and inclination data.
Figure 4:
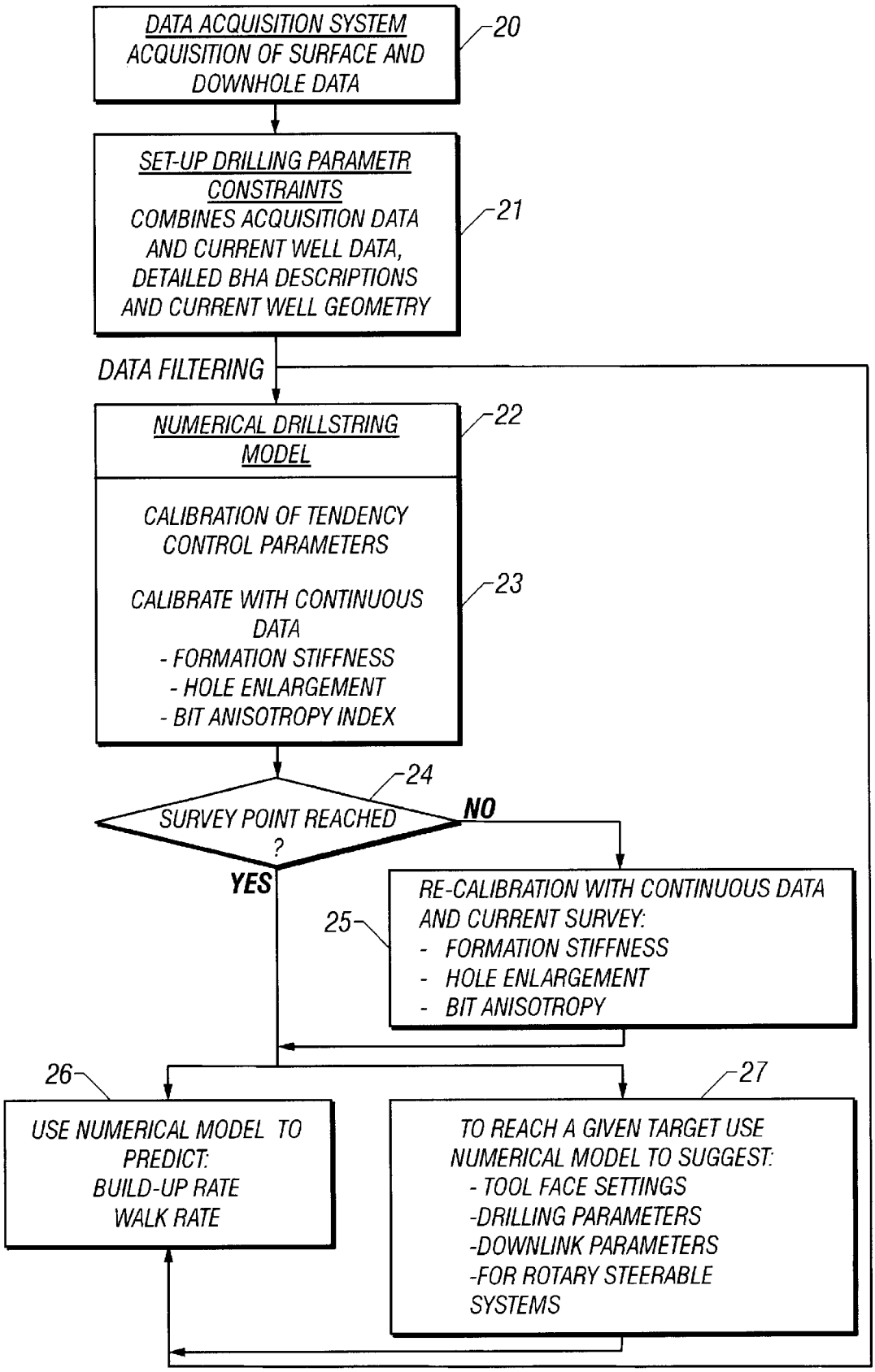
FIG. 4 is a flowchart of real-time directional tendency prediction.

The methodology of the invention is shown in FIG. 4 and described in the following set of enumerated steps. The first step is a Data Acquisition step. In this step, surface and down hole drilling data are continuously acquired by the surface acquisition system using known acquisition techniques. The relevant surface data parameters acquired in this phase are:

Hookload

Surface and downhole weight-on-bit

Surface and downhole torque

The relevant down hole parameters acquired in this phase are:

Bit RPM

Rate of Penetration (ROP)

Tool face

Continuous direction and inclination

Inclination at the bit

Not all of the above data are necessary for the method described herein. For example, the method should still give reasonable wellbore tendency predictions in the absence of the inclination at the bit measurement, and the RPM parameters.

This step also includes processing the data 21 acquired in step 20 as needed. This processing procedure may involve some data filtering. Given the frequency of the data, some filtering may be necessary to ensure that the above data channels are not too noisy, so that reasonable numerical computations can be made. This filtering can be undertaken either by the surface acquisition system or a pre-processor to the numerical model.

The second step of this process is to set-up drilling parameter constraints 21. The numerical model of the present invention requires the following information about the drilling environment:

Current surface positional data of the well location

A detailed description of the drill string and bottom hole assembly, including component weights and dimensions (internal and external diameters, maximum external diameters), component bending stiffness, and positions and gauge of stabilizers.

A complete description of the borehole geometry including the length, type/grade, setting depth and dimensions of the casing string(s) and whether a section of the hole open or cased, and the hole size and gauge as a function of depth.

Relative location of any D & I sensors to the bit. This information may be in the form of a current well survey which will contain inclination, azimuth and measured depth information.

This data is also filtered prior to use in the numerical drill string model. This step combines the acquired data from step 20 with related drilling data to produce a fully described drilling environment for the drilling tool.

The next step in the invention is to create a numerical drill string model 22 in order to predict the direction and inclination of the wellbore being drilled. Once fed with the static data of the bottom hole assembly (BHA) and the wellbore geometry, and with the real-time data, tool description and initial drilling parameters, the numerical model will calibrate the formation stiffness, hole enlargement and bit anisotropy index, based on continuous measurements of inclination and azimuth in the previously drilled wellbore sections. These control parameters are continuously calibrated as data is acquired to refine the prediction of inclination and azimuth of the next wellbore section to be drilled as indicated in the steps 25 and 26. As shown in the flowchart in FIG. 6, the first step 30 in creating this numerical model is to define a calibration interval in the recently drilled section with available continuous D&I measurements (FIG. 5*b*). This interval must have the same drilling conditions (sliding or rotating) and a nominally constant downhole weight-on-bit (DWOB). The FS, HE and BAI parameters are assumed to be constant in a calibration interval. The side force at the bit (BSF) is also assumed to be linearly varying versus the measured depth in the calibration interval. The ideal length of a calibration interval is chosen by analyzing the continuous D&I data such that the interval will contain at least three different subsections where the well curvatures are substantially different. Then, the calibration interval is subdivided into subsections 31 as shown in the FIG. 9. The end points of these subsections are $P_1$, $P_2$, and $P_3$ (Step 2 in the flowchart). The next step 32 is to identify the dominant parameters among FS, HE and BAI in a calibration interval. An examination of the drilling parameters (DWOB, DTOR, and Bit RPM) and the relationship of these parameters with the rate of penetration (ROP) can determine the most dominant parameter. An example of a dominant parameter is a drastic change in ROP with the same drilling parameters. This change in ROP may imply a change in the formation, and therefore the formation stiffness would be the dominant parameter and should be properly calibrated. Alternatively, if there is a substantial change in the well curvature between the actual and previous calibration intervals under the same drilling conditions (either sliding or rotating) while the ROP remains relatively constant then the most important parameter should be hole enlargement. Once the dominant parameter has been determined, the next step 33 is to determine the values of coefficients $A_i$, $B_i$, and $C_i$ in equation 1 by performing a sensitivity study of the FS, HE and BAI parameters in each subsection using a BHA analysis software tool such as Bit Side Forces Analysis in Schlumberger's DrillSAFE software. This software computes the Side Force at the Bit when the well trajectory, the formation stiffness, the hole enlargement and the bit anisotropy index along the wellbore are known.

The sensitivity study of the subsection i (i can take 3 values: 1, 2, or 3) will enable the determination of the coefficients $A_i$, $B_i$, and $C_i$. The coefficient $A_i$ represents the rate of change of the BSF versus the variation of formation stiffness (FS). For example, $A_i$ can be determined by computing the BSF in two fictitious wellbore configurations. The first configuration assumes FS, HE and BAI in the current calibration interval are the same as the previous interval. The second configuration is the same as the first, only the FS is slightly changed. The coefficients $B_i$, and $C_i$ represent respectively the rate of change of the BSF versus the variation of HE and the rate of change of the BSF versus the variation of BAI. Coefficients $B_i$, and $C_i$ can be determined by the same manner as in $A_i$. With $A_i$, $B_i$ and $C_i$ being known, the Side Force at the Bit at the location $P_i$ (FIG. 9) in this subsection can be expressed by the following equation:

$$BSF_i = BSF_i^0 + A_i(FS - FS_0) + B_i(HE - HE_0) + C_i(BAI - BAI_0) \quad \text{Equation (1)}$$

where $BSF_i$ is the unknown Bit Side Force, because FS, HE and BAI are unknown. $BSF_i^0$, is the BSF computed by assuming the same FS, HE, BAI as in the previous calibration interval. ($FS_0$, $HE_0$, $BAI_0$) are respectively the FS, HE and BAI of the previous calibration interval. At this point, the only variable parameters in equation 1 are FS, HE and BAI.

Figure 9:
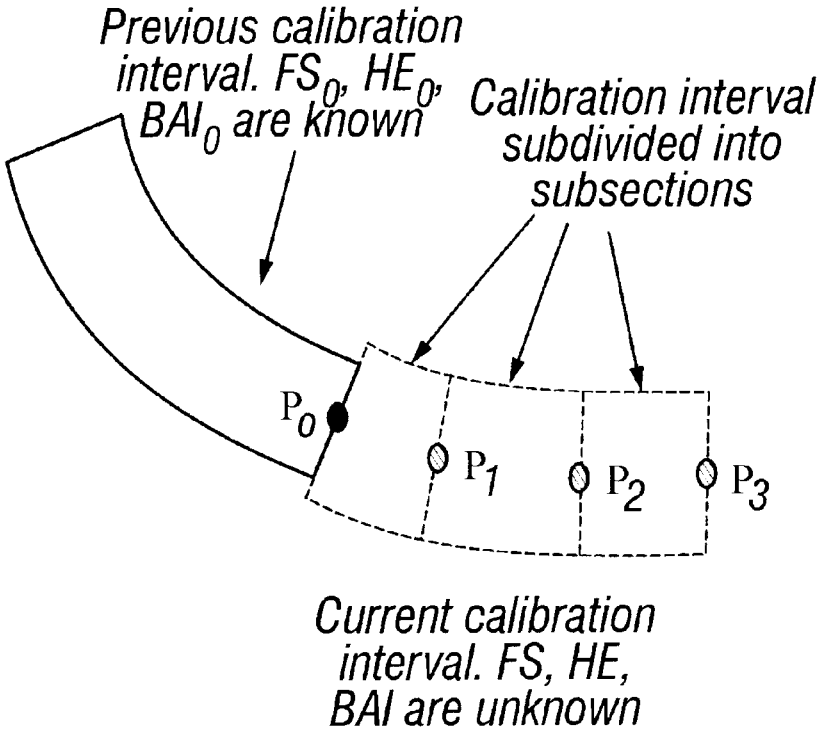
FIG. 9 is an illustration of sub-sections of a calibration interval.

The next step 34 is to determine the BSF in each subsection using the following equation:

$$BSF_i - BSF_{i-1} = \frac{DWOB}{1 - BAI}(DLS_i - DLS_{i-1})(MD_i - MD_{i-1}) \quad \text{Equation (2)}$$

Where $DLS_i$ is the dogleg severity of the subsection number i, and $MD_i$ is the measured depth of the location $P_i$ (FIG. 9). These parameters are known because the inclination and azimuth are known. Equation (2) is derived from the definition of the Bit Anisotropy Index for the simple case of 2-D well (i.e. the azimuth of the well is unchanged). In a general 3-D well, the same type of equation can be used to relate the inclination component of the BSF to the inclination component of dogleg severity, i.e. the rate of change in inclination and the azimuth component of BSF to the azimuth component of the dogleg severity. A system of 3 equations and 3 unknowns, FS, HE and BAI, can then be generated by substituting $BSF_i$ in the equation 2 into the equation 1.

The next step 35 of the calibration process is to resolve the three generated equations. These equations may not always be resolvable because two of them can be dependent each other. If it is the case, only dominant parameters identified in the step number 3 of the flowchart will be retained, and other parameters are assumed to be the same as the previous calibration interval.

In step 36, there is a determination of HE, FS and BAI for each subsection using the calculated coefficient constants $A_i$, $B_i$, and $C_i$ and the BSF and the $FS_0$, $HE_0$ and $BAI_0$ from the previous measured section. The determined FS, HE and BAI parameters are then used to determine the curve rate 37.

Figure 10:
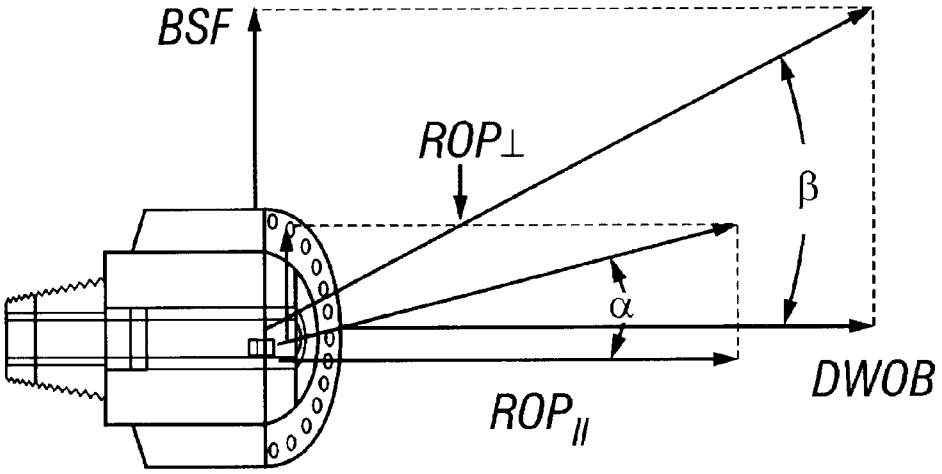
FIG. 10 is a schematic representation of the Bit Anisotropy Index.

The bit anisotropy index used in equation (2) and shown in FIG. 10, represents the change in drilling direction of the bit in response to the total drilling force at the Bit, i.e. the vector sum of the downhole weight on bit (DWOB) and the side force at the bit (BSF). Its definition is given by the relationship:

$$BAI = 1 - \frac{\tan(\alpha)}{\tan(\beta)}$$

where $\alpha$ is the angle between the drilling direction and the wellbore axis, $\beta$ the angles between the total force at the bit and the wellbore axis (FIG. 10). The bit anisotropy index allows determination of the side force at the bit (BSF) with respect to the rate of penetration (ROP) by using the following equation:

$$\frac{ROP_\perp}{ROP_\parallel} = \frac{BSF}{DWOB}(1 - BAI)$$

where $ROP_\perp$ is the rate of penetration in the direction perpendicular to the wellbore axis and $ROP_\parallel$ is the rate of penetration in the direction parallel to the wellbore axis. Depending on the bit geometry and the disposition of cutters, the bit anisotropy index (BAI) can take any value between 0 and 1. A bit with BAI=0, i.e., an isotropic bit, has the same drilling direction as the direction of the total force at the bit.

In summary, these steps 22 and 23 will calibrate with continuous data the FS, HE and BAI along the wellbore. Before reaching a survey point 24 the step will recalibrate FS, HE and BAI with continuous data and current survey data. When a new survey is acquired 25, a directional driller can choose whether to (1) just use the numerical model data to just predict the build-up rate and walk rate so that he can predict the trajectory of the well for the next few stands or (2) to ask the model how to reach a given target. In this option, based on the slide sheet schedule, the numerical model can suggest: tool face settings, drilling parameters and downlink parameters for a rotary steerable system that will enable the well to maintain a certain trajectory and reach a desired target.

With the model parameters calibrated, in the next step 26 of FIG. 4, a prediction is made of the expected build-up rate and walk rate of the BHA for the next strand to be drilled. These rates are then used to predict the expected wellbore trajectory.

In addition to the predicted build-up rate and turn rate, a given target may be specified,and in step 27 the model will calculate the parameters (tool face setting, weight-on-bit, downlink configuration parameters for a rotary steerable system) that the DD will need to reach that target. Ultimately, one can envisage a closed-loop system whereby the downhole tool will set the best path to reach a target that has been specified at the surface, so that for example the tortuosity is minimized.

Figure 5:
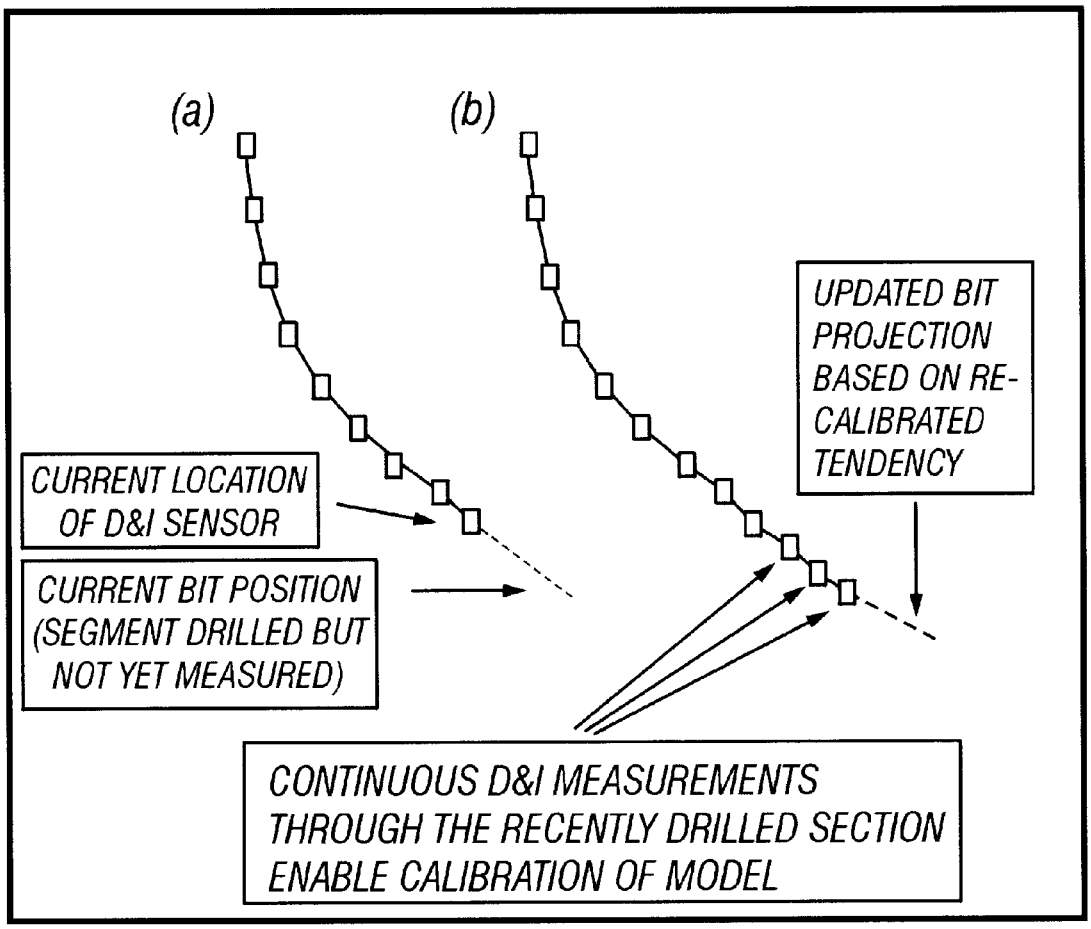
FIG. 5 is one method for obtaining more accurate BHA tendency calibration based on continuous calibration of direction and inclination.
Figure 6:
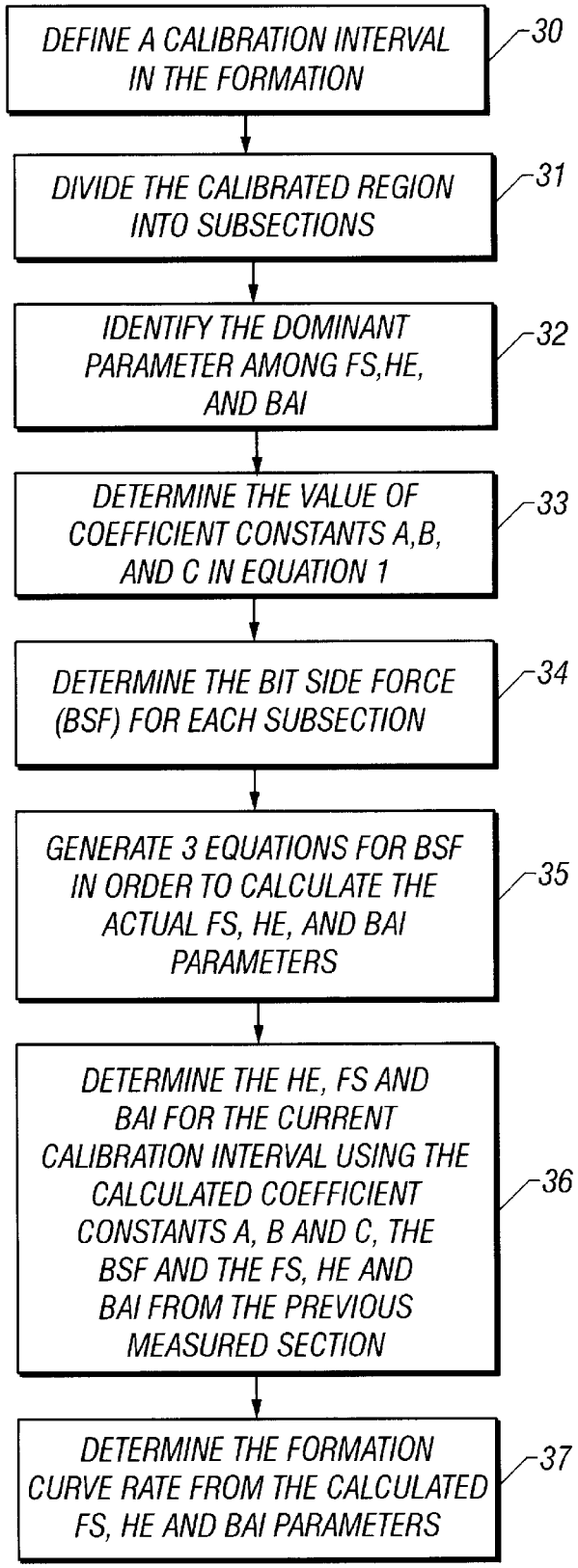
FIG. 6 is a flowchart of the calibration process of the present invention. (need to modify the text in block labeled '36' in FIG. 6. The text should read: "Determine the HE, FS, and BAI for the current calibration interval using the calculated coefficient constants A,B,C, the BSF, and the FS, HE, and BAI from the previous measured section".
Figure 7:
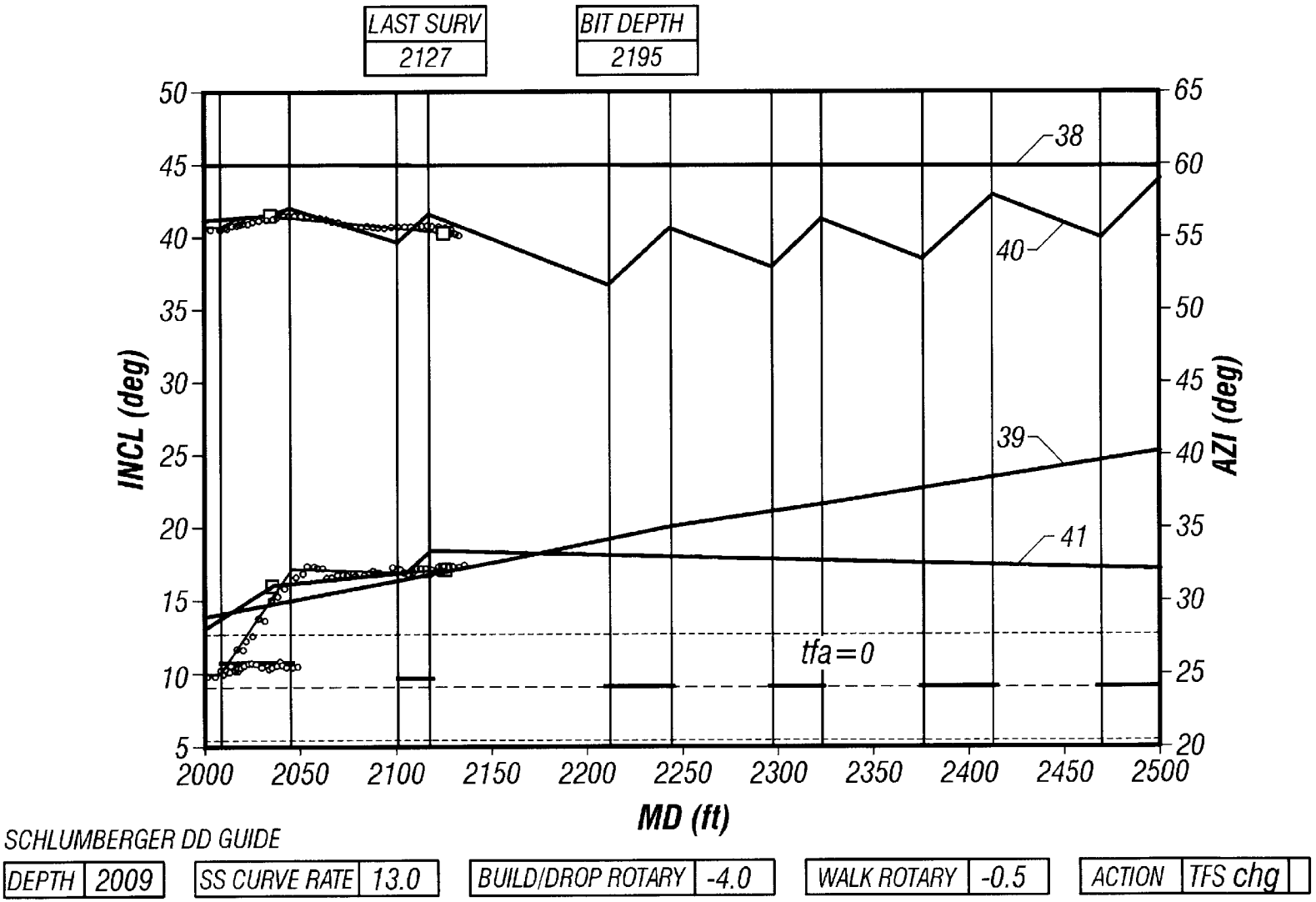
FIG. 7 is a sequence in adjusting the predicted trajectory of the wellbore having a tool face angle of zero.
Figure 8:
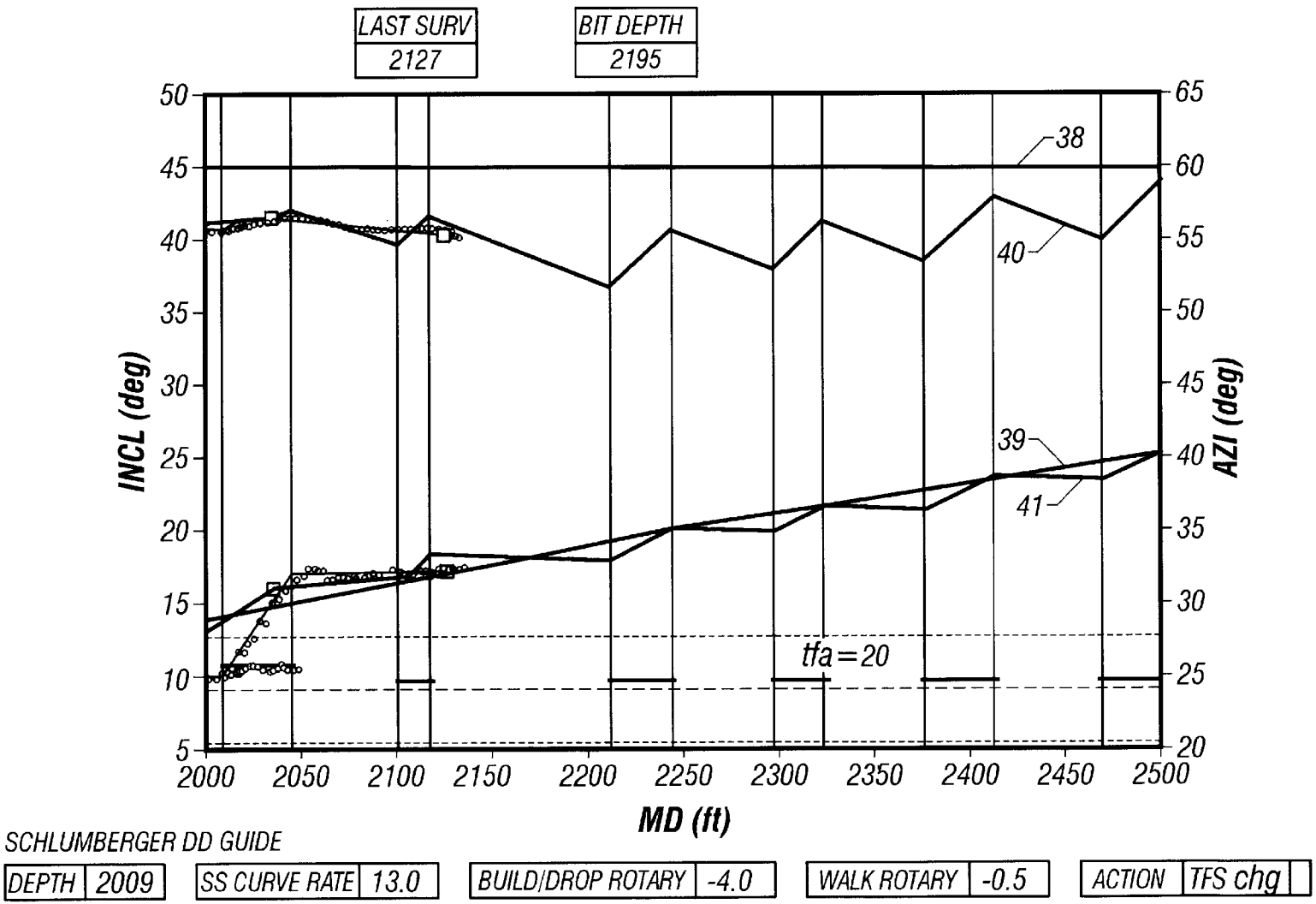
FIG. 8 is a sequence in adjusting the predicted trajectory of the wellbore having a tool face angle of 20.

The flowchart of FIG. 4 shows the workflow of the intended operation of the invention. FIG. 5 illustrates how the system will continuously re-calibrate the predicted bit position/BHA tendency once the MWD D&I sensor has passed a specified distance in measured depth. In (a) the location of the bit and the MWD sensor (and the at-bit inclination measurement, if one is present) are shown. The dashed line illustrates that at this time the precise location of the bit is unknown. The squares show the positions at which continuous D&I points have been obtained to this point. This data is used to calibrate the parameters that have already been defined in the finite numerical model, and the model is then used to then predict the build and walk rate tendencies to the bit (and beyond if necessary). In (b), once the D&I sensor has reached the measured depth of the bit, the current position as measured by the sensor can be compared to the predicted position obtained from the calculation in (a). The parameters in the numerical model can then be re-calibrated to give an updated prediction of the bit position and the new BHA tendency. Note that the method of continuous calibration described above will reduce the uncertainty in the follow-through that was described earlier. FIG. 7 shows an implementation of step 27 of the present invention in which the directional driller wants to change the projected wellbore trajectory to reach a desired formation target. As shown, the wellbore trajectory should follow the direction 38 and inclination 39 in order to reach the targeted formation. The actual direction 40 and inclination 41 show that the direction trajectory is generally as desired. However, the actual inclination 41 is substantially off from the desired direction trajectory. In order to change the trajectory of the inclination 41 without substantially altering the trajectory of the direction 40, the DD has the option of changing some of the drilling parameters. The DD could decide to change the type of drilling for a particular interval from slide to rotate or vice versa. The DD could also change the tool face angle. In FIG. 7 the tool face angle is zero. FIG. 8 is an example of the tool face angle at 20. The result is that the direction 40 has moved slightly away from the preferred trajectory 38. However, the inclination 41 has changed such that the projected trajectory is close to the desired trajectory 39. With this step, the DD has ensured that the wellbore will follow the defined path to reach the desired target formation. The methods of this invention provide significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention, which is limited only by the following claims.

We claim:

1. A method for predicting the directional tendency of a drilling assembly in real-time comprising the steps of:

acquiring survey data of a drilling environment;

determining a directional tendency from the survey data for at least one drilling mode; and predicting the wellbore trajectory using the determined directional tendency.

2. The method of claim 1 wherein said acquired data includes surface and downhole data.

3. The method of claim 2 wherein said surface data includes hookload, torque and rpm parameters.

4. The method of claim 2 wherein said downhole data includes weight-on-bit, torque and continuous inclination and drilling parameters.

5. The method of claim 1 wherein the step of acquiring includes the step of filtering said acquired data to ensure that reasonable numerical computations can be made.

6. The method of claim 1 wherein said acquired data comprises static data comprising well survey, well geometry and bottom hole assembly description data.

7. The method of claim 6 further comprising the step of establishing drilling parameter constraints from said acquired data.

8. The method of claim 7 wherein said drilling parameter constraint data is filtered and used to calibrate the directional tendency.

9. The method of claim 8 wherein a numerical drill string model is used to calibrate said directional tendency.

10. The method of claim 1 further comprising the step of continuously re-calibrating the predicted trajectory until the borehole assembly has reached a survey point.

11. The method of claim 1 wherein the prediction of the wellbore trajectory includes predicting the build-up rate and the walk rate.

12. The method of claim 10 further comprising the step of calculating parameters that will be necessary for the wellbore being drilled to reach a target formation location.

13. The method of claim 12 wherein said parameters include the tool face setting, the weight-on-bit and the downhole configuration parameters.

14. A method for predicting the directional tendency of a drilling assembly in real-time comprising the steps of:

acquiring survey data of a drilling environment;

determining a directional tendency from the survey data for at least one drilling mode;

predicting the wellbore trajectory using the determined directional tendency; and calculating drilling parameters that will be necessary for the wellbore being drilled to reach a target formation location.

15. The method of claim 14 wherein said acquired data includes surface data and downhole data.

16. The method of claim 14 wherein the step of acquiring includes the step of filtering said acquired data to ensure that reasonable numerical computations can be made.

17. The method of claim 14 wherein said acquired data comprises static data comprising well survey, well geometry and bottom hole assembly description data.

18. The method of claim 17 further comprising the step of establishing drilling parameter constraints from said acquired data.

19. The method of claim 18 wherein said drilling parameter constraint data is filtered and used to calibrate directional tendency.

20. The method of claim 1 further comprising the step of continuously re-calibrating the predicted trajectory until the borehole assembly has reached a survey point downhole data.

21. A method for calibrating the directional tendency of a drilling assembly in real-time comprising the steps of:

acquiring survey data of a drilling environment;

filtering said acquired data to ensure that reasonable numerical computations can be made;

establishing drilling parameter restraints from said acquired data; and modeling the drill string parameters in order to determine a directional tendency from said acquired data for at least one drilling mode.

22. The method of claim 21 wherein said acquired data includes surfaces data and downhole data.

23. The method of claim 21 further including the step of calibrating the directional tendency using the drilling modes.

24. The method of claim 21 wherein said drilling parameter restraint data is filtered and used to calibrate directional tendency using the drilling modes.

25. The method of claim 21 further comprising the step of predicting the wellbore trajectory using the determined directional tendency and continuously re-calibrating the predicted trajectory until the borehole assembly has reached a survey point.

26. The method of claim 25 wherein the prediction of the wellbore trajectory includes predicting the build-up rate and the walk rate.

27. The method of claim 24 further comprising the step of calculating parameters that will be necessary for the wellbore being drilled to reach a target formation location.

28. A method for calibrating the directional tendency of a drilling assembly based on drilling information of a previously drilled wellbore comprising the steps of:

Compiling data of the drilling environment of the previously drilled wellbore;

Determining a directional tendency from the compiled data for at least one drilling mode; and Predicting a wellbore trajectory using the determined directional tendency.

29. The method claim 28 wherein said complied data includes surface data and downhole data.

30. The method of claim 28 wherein the step of compiling includes the step of filtering said acquired data to ensure that reasonable numerical computations can be made.

31. The method of claim 28 wherein said compiled data comprises static data comprising well survey, well geometry and bottom hole assembly description data.

32. The method of claim 31 further comprising the step of establishing drilling parameter constraints from said acquired data.

33. The method of claim 32 wherein said drilling parameter constraint data is filtered and used to calibrate directional tendency.

34. The method of claim 33 wherein a numerical drill string model is used to calibrate said trajectory tendency control parameters.

35. The method of claim 28 further comprising the step of continuously re-calibrating the predicted trajectory until the borehole assembly has reached a survey point.

36. The method of claim 1 further comprising the step of calibrating the determined directional tendency using the drilling modes.

37. The method of claim 1 wherein the at least one drilling mode is selected from the group of sliding and rotary.

38. The method of claim 1 wherein the directional tendency comprises control parameters selected from the group of formation stiffness, hole enlargement and bit anisotropy.

39. The method of claim 14 further comprising the step of calibrating the determined directional tendency using the drilling modes.

40. The method of claim 14 wherein the at least one drilling mode is selected from the group of sliding and rotary.

41. The method of claim 14 wherein the directional tendency comprises control parameters selected from the group of formation stiffness, hole enlargement and bit anisotropy.

42. The method of claim 21 wherein the at least one drilling mode is selected from the group of sliding and rotary.

43. The method of claim 21 wherein the directional tendency comprises control parameters selected from the group of formation stiffness, hole enlargement and bit anisotropy.

44. The method of claim 28 further comprising the step of calibrating the determined directional tendency using the drilling modes.

45. The method of claim 28 wherein the at least one drilling mode is selected from the group of sliding and rotary.

46. The method of claim 28 wherein the directional tendency comprises control parameters selected from the group of formation stiffness, hole enlargement and bit anisotropy.

* * * * *